United States Patent [19]

Czopor, Jr.

[11] Patent Number: 4,619,364

[45] Date of Patent: Oct. 28, 1986

[54] DISPLAY PACKAGE FOR DRILL BITS AND THE LIKE

[75] Inventor: Edmund J. Czopor, Jr., Burlington, Conn.

[73] Assignee: The Stanley Works, New Britain, Conn.

[21] Appl. No.: 417,142

[22] Filed: Sep. 13, 1982

[51] Int. Cl.[4] ..... B65D 85/28

[52] U.S. Cl. ..... 206/379; 206/380; 206/461; 206/470; 206/477; 206/480

[58] Field of Search ..... 206/461, 462, 463, 464, 206/465, 467, 370–380, 470, 477, 480, 486

[56] References Cited

U.S. PATENT DOCUMENTS

| | | | |
|---|---|---|---|
| 2,792,934 | 5/1957 | Rocchetti | 206/379 |
| 2,792,935 | 5/1957 | Rocchetti | 206/379 |
| 3,111,220 | 11/1963 | Bostrom | 206/470 |
| 3,179,246 | 4/1965 | Rosenburg, Jr. | 206/462 |
| 3,420,361 | 1/1969 | Newberg | 206/470 |
| 4,005,776 | 2/1977 | Seeley | 206/470 |
| 4,016,972 | 4/1977 | Szamborski | 206/470 |
| 4,091,927 | 5/1978 | Lonsford | 206/467 |
| 4,186,073 | 1/1980 | Paganoni | 206/380 |
| 4,260,057 | 4/1981 | Wall-Andersen | 206/379 |

FOREIGN PATENT DOCUMENTS

| | | | |
|---|---|---|---|
| 7532734 | 10/1975 | France | 206/462 |

*Primary Examiner*—Joseph M. Moy
*Assistant Examiner*—David T. Fidei

[57] ABSTRACT

A package for a set of twist drill bits or like tools consists of a one-piece, integrally thermoformed case, having a pedestal portion on its base component in which a series of tool-receiving recesses is defined. The closure component of the case has a cavity in which the pedestal portion is seated in the closed position, and in which may also be received a card insert for advertising and identification of the contained parts. The insert has at least one opening through which portions of the parts are visible, the material of fabrication of the case being transparent. Means is generally provided to increase the security of interengagement between the base and closure components.

15 Claims, 6 Drawing Figures

DISPLAY PACKAGE FOR DRILL BITS AND THE LIKE

BACKGROUND OF THE INVENTION

Tool parts, such as twist drill bits, are normally sold in sets consisting of several different sizes of the type of part. A variety of containers for the packaging and subsequent storage of such sets are available, and they are often of molded plastic construction.

An exemplary container of this nature is described in U.S. Pat. No. 2,844,244, to Hanson. Although the case disclosed is said to be relatively simple and inexpensive, it will be appreciated that its design would not permit fabrication by a thermoforming technique, as would tend to minimize manufacturing difficulty and expense. The patentee endeavors to provide a plastic case that is extremely durable and long-lasting; in many instances such features are unnecessary, and the cost entailed cannot be justified. Similar cases are disclosed in U.S. Pat. Nos. 2,880,857 to Parsons et al, and 3,154,192 to Cowley.

Accordingly, it is a primary object of the present invention to provide a novel one-piece, integrally thermoformed plastic case for a set of twist drill bits and the like, which case is relatively simple and inexpensive to produce.

It is also an object of the invention to provide such a case which is well-suited for packaging tool parts in a secure and attractive manner, and which is of adequate durability to enable reuse for storage of the parts by the consumer.

Another object of the invention is to provide a novel package comprised of a one-piece, integrally formed plastic case and a set of elongated tool parts contained therewithin.

A more specific object is to provide such a package having means therein for advertising and identifying the parts, while contributing to the attractive and effective display thereof.

SUMMARY OF THE INVENTION

It has now been found that certain of the foregoing and related objects of the invention are readily attained in a one-piece case for holding a multiplicity of elongated tool parts, comprising a base component, a closure component, and a connecting hinge component, all integrally thermoformed from a synthetic resinous material. The base component includes an inwardly extending pedestal portion, which has an inwardly opening cavity defined therewithin and a peripheral sidewall element extending thereabout. A multiplicity of internal rib formations subdivide the cavity of the pedestal portion into a multiplicity of elongated tool-receiving recesses; the base component also includes a peripheral flange portion which projects laterally about the outer edge of the sidewall element of the pedestal portion.

The closure component is pivotable about the integral hinge between a closed position overlying the base component and an open position displaced therefrom. It has a sidewall element and a peripheral-flange portion extending thereabout, which correspond to the sidewall element and the flange portion of the base component and are dimensioned and configured to lie in surface contact therewith in the closed position. The closure component also has a cover element which extends thereacross and defines therewith an inwardly opening cavity. When the case is in its closed position, the pedestal portion of the base component seats within the cavity of the closure component, the respective peripheral flange portions are disposed in face-to-face surface contact, and the respective sidewall elements thereof are in frictional interengagement.

In the preferred embodiments, the pedestal portion of the base component will include a multiplicity of peripheral rib formations of generally inverted U-shaped configuration, defining the cavity therewithin and having the sidewall element thereon. The sidewall elements of the base and closure components will normally extend continuously thereabout. To best adapt the case for holding a set of drill bits, the internal rib formations will be generally parallel to one another and of progressively increasing length and spacing from one another. Most desirably, the lateral walls of the internal rib formations will have bosses projecting therefrom into the recesses therebetween, which bosses will be disposed on the wall in a pattern for gripping a drill bit of appropriate size therebetween. The pedestal portion of such a case will desirably be of generally rectangular configuration, and may additionally include a rib formation spaced outwardly from the ends of the internal rib formations and parallel thereto, the ends of the internal rib formation lying on an imaginary diagonal line extending across the pedestal portion. A generally rhomboidal section will thereby be defined within the cavity, for receiving the ends of drill bits held within the recesses.

The peripheral flange portions will usually extend entirely about the base and closure components, with the hinge component being connected thereto along one side of the case. At least one element of the flange portion on the opposite side of the case will advantageously be foreshortened, so as to permit ready access to the underlying flange element.

Certain objects of the invention are attained in a package comprised of a one-piece case having the construction hereinabove described, and a multiplicity of elongated tool parts, each of the parts being held within one of the tool-receiving recesses of the case. Generally, the case will be fabricated from a transparent material, and the package will desirably additionally include a card insert disposed within, and conforming to, the cavity of the closure component; the card insert will have at least one opening formed therein and through which the tool parts held within the recesses of the base component are visible. In those instances in which the cavity of the pedestal portion has a section in which the ends of the drill bits are disposed, the opening of the card will be aligned therewith to render the ends of the drill bits visible therethrough. In other instances, the card may have a series of slots formed therein, each being aligned over a different one of the recesses, again to render a tool part held therewithin visible. Generally, the package will also include means for securing the closure component to the base component in the closed position of the case, which securing means may comprise at least one fastener component inserted through the overlying marginal flange portions of the two components.

DETAILED DESCRIPTION OF THE ILLUSTRATED EMBODIMENTS

Figure 1:
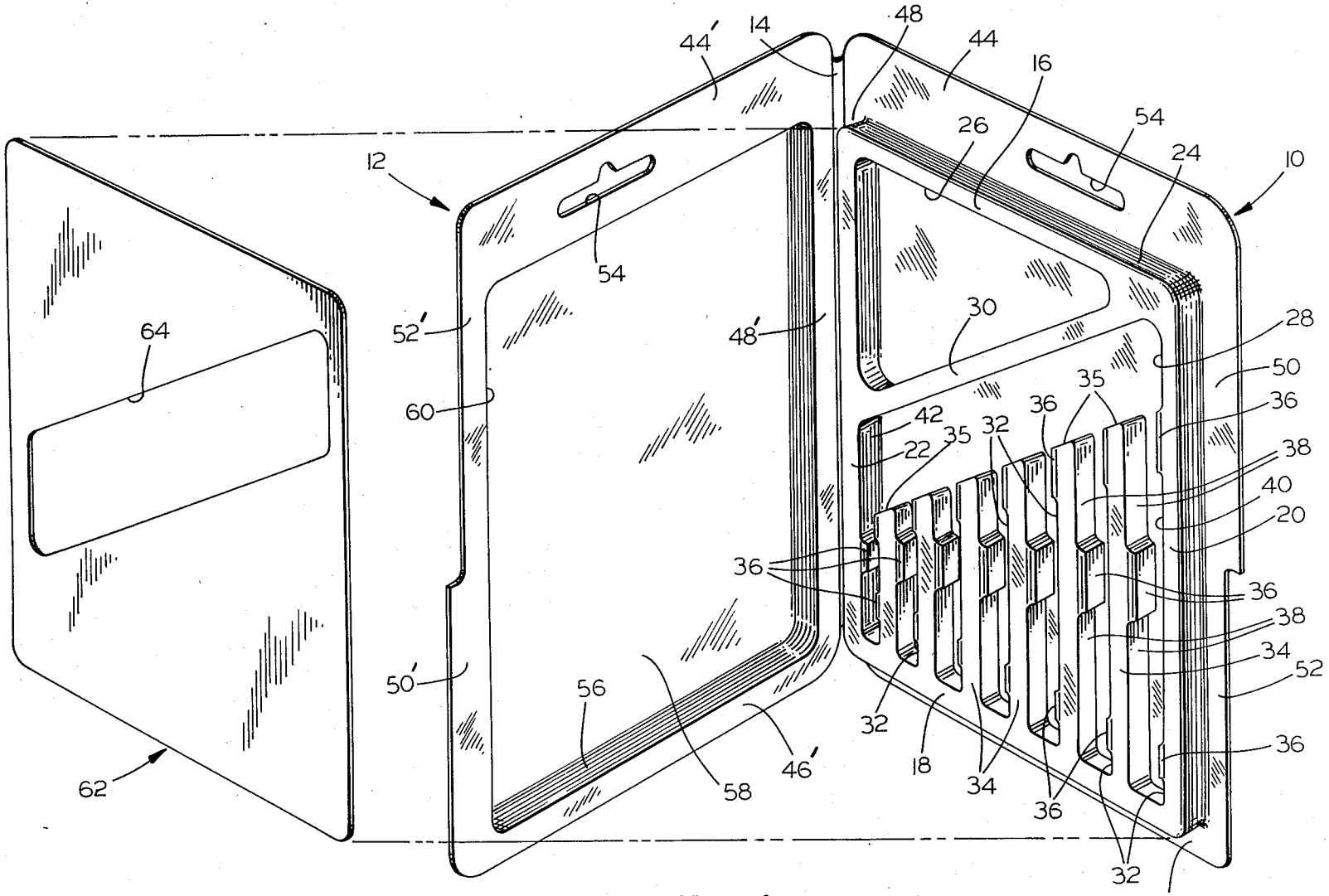
FIG. 1 is an exploded perspective view of a one-piece, integrally thermoformed plastic case embodying the present invention, with the card insert used therewith removed therefrom.

Turning now in detail to FIGS. 1-4 of the appended drawings, therein illustrated is a one-piece twist drill bit case embodying the present invention and consisting of a base generally designated by the numeral 10, a closure generally designated by the numeral 12, and an integral hinge 14 therebetween. The base 10 is formed with a pedestal portion comprised of a multiplicity of interconnected rib formations of double-wall construction, the peripheral ribs 16, 18, 20, and 22 (at the top, bottom, front and rear of the pedestal portion, respectively) defining an internal cavity and providing the continuous inverted U-shaped peripheral sidewall 24 thereabout. The cavity is divided into an upper section 26 and a lower section 28 by a diagonal rib 30 of similar inverted U-shaped cross section, and the lower cavity section 28 is further divided into elongated recesses 32 by six generally parallel internal ribs 34 of progressively varying length; the ribs 34 are of inverted U-shaped cross section and extend from the bottom rib 18 toward the top rib 16; and they have end walls 35 which lie on an imaginary diagonal line that is parallel to the rib 30. Each internal rib 34 has three generally rectangular bosses 36 projecting into the adjacent recesses 32 from its opposite sidewalls 38, the bosses 36 being so arranged that one of them is disposed between a pair thereof projecting from the confronting sidewall 38 of the adjacent rib 34. Similar bosses 36 are provided on the inside walls 40, 42 of the front and rear peripheral ribs 20, 22, respectively, to cooperate, in the manner described, with the bosses on the adjacent internal ribs 34.

The peripheral sidewall 24 merges into a peripheral flange, which extends about the pedestal portion and consists of top, bottom, and inner side portions, 44, 46 and 48, respectively, and an outer side portion consisting of two sections 50, 52 of different widths. The hinge 14 is connected to the base 10 along the inner side flange portion 48, and the top flange portion 44 is slotted at 54 to provide an aperture for supporting the package on a suitable hook or hanger, in a conventional manner.

The closure 12 has a marginal flange consisting of top, bottom, inner side and outer side portions 44', 46', 48', 50' and 52', respectively, which correspond to the flange portions of the base 10; the relative positions of the sections 50', 52' are, however, reversed from the corresponding sections 50, 52 of the base flange. The hinge 14 is joined along the inner side flange portion 48', and the top flange portion 44' has an aperture 54 corresponding to that which is formed in the base flange portion 48. A peripheral wall 56 extends outwardly from the inside edge of the flange of the closure 12, and merges into the outer wall 58 thereof, which walls 56, 58 define a cavity 60 within the closure 12.

Figure 3:
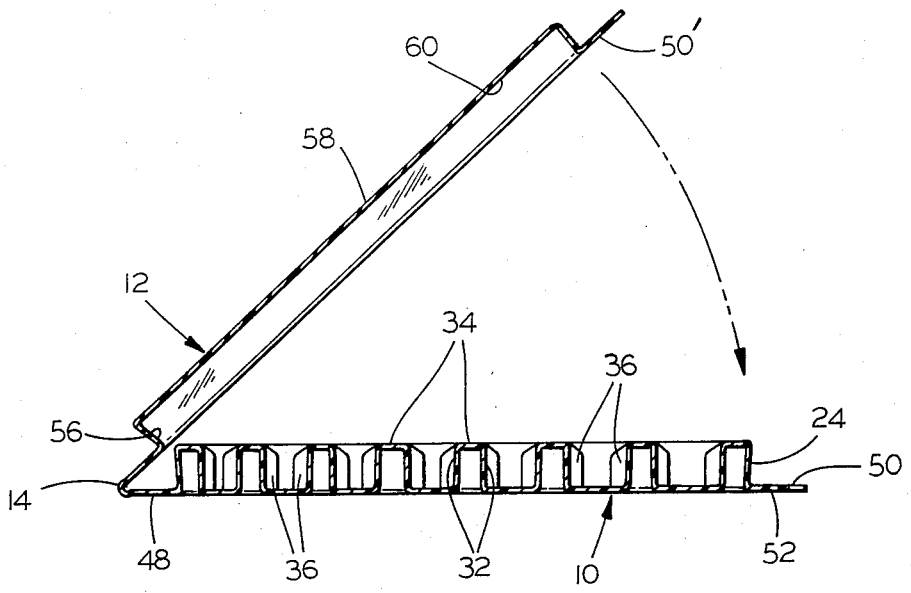
FIG. 3 is a sectional view of the case along the line 3—3 of FIG. 2 and drawn substantially to the scale thereof.
Figure 4:
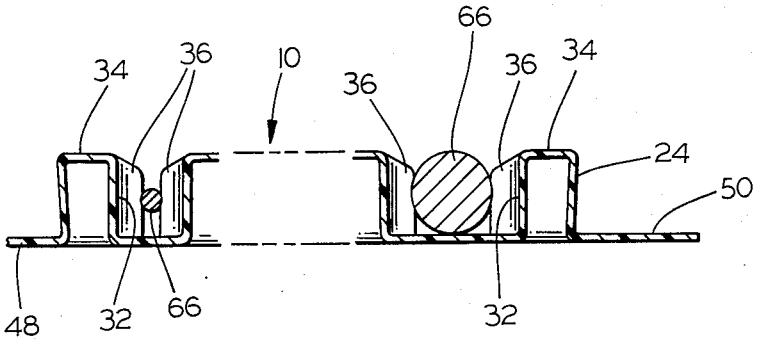
FIG. 4 is a fragmentary sectional view of the base component of the case, drawn to a further enlarged scale and showing two drill bits of different sizes received within the suitable recesses thereof.

It will readily be appreciated that the closure 12 is adapted to pivot about the hinge 14 to a position directly over the base 10, with the pedestal portion of the latter seated within the cavity 60 of the former, and with the respective peripheral sidewalls 24, 56 in close-fitting frictional engagement; as best seen in FIG. 3, the walls 24, 56 may be formed with a slight angle or reverse taper, to enhance the inherent security of interengagement. In the closed position of the case, the apertures 56 through the cover and base flanges are aligned to provide the opening for insertion of a pegboard hanger or the like for mounting on a display. The outer side flange sections 50, 50', 52, 52' are disposed in an offset relationship; the wider sections 50, 50' extend beyond the narrower sections 52' , 52, respectively, to facilitate access and opening of the package.

Figure 5:
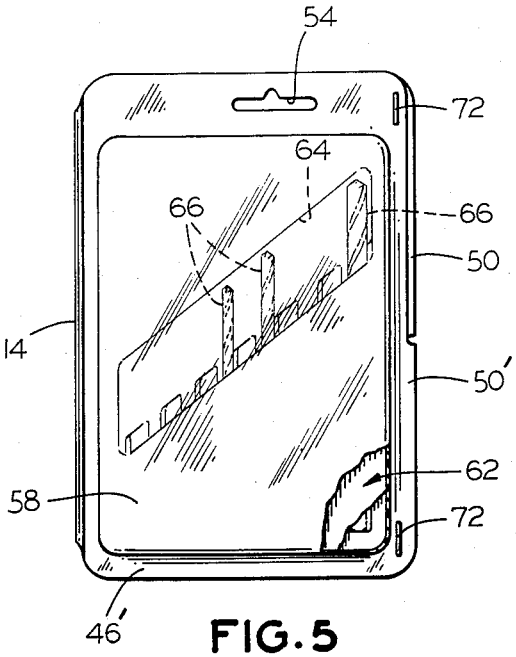
FIG. 5 is a plan view of a package of drill bits embodying the present invention, with portions broken away to illustrate internal construction.

Also included is a card insert, generally designated by the numeral 62, which is dimensioned and configured to seat in the cavity 60 of the closure 12, and it is generally printed to identify the packaged articles and/or for decorative or advertising purposes. The card 62 has a rhomboidal opening 64 which is dimensioned and configured to correspond to that part of the cavity section 28 that lies beyond the ends 35 of the internal ribs 34. According1y, when the card 62 is in place within the package, the ends of the drill bits 66 projecting from the recesses 32 will be visible through the card opening 64, as is illustrated in FIG. 5. As is also seen in that Figure, wire staples 72 may be used to fasten the flange portions of the base and closure together, thereby discouraging pilferage of the contents of the package at the point of sale.

Figure 6:
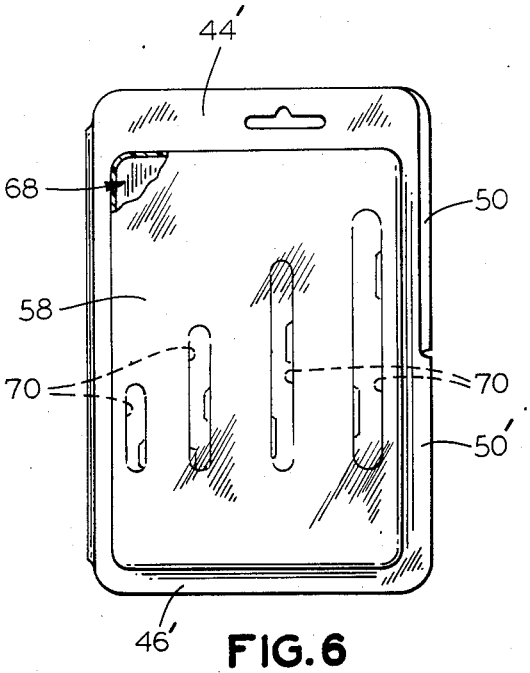
FIG. 6 is a view similar to that of FIG. 5, showing a package containing a card insert of different design.
Figure 2:
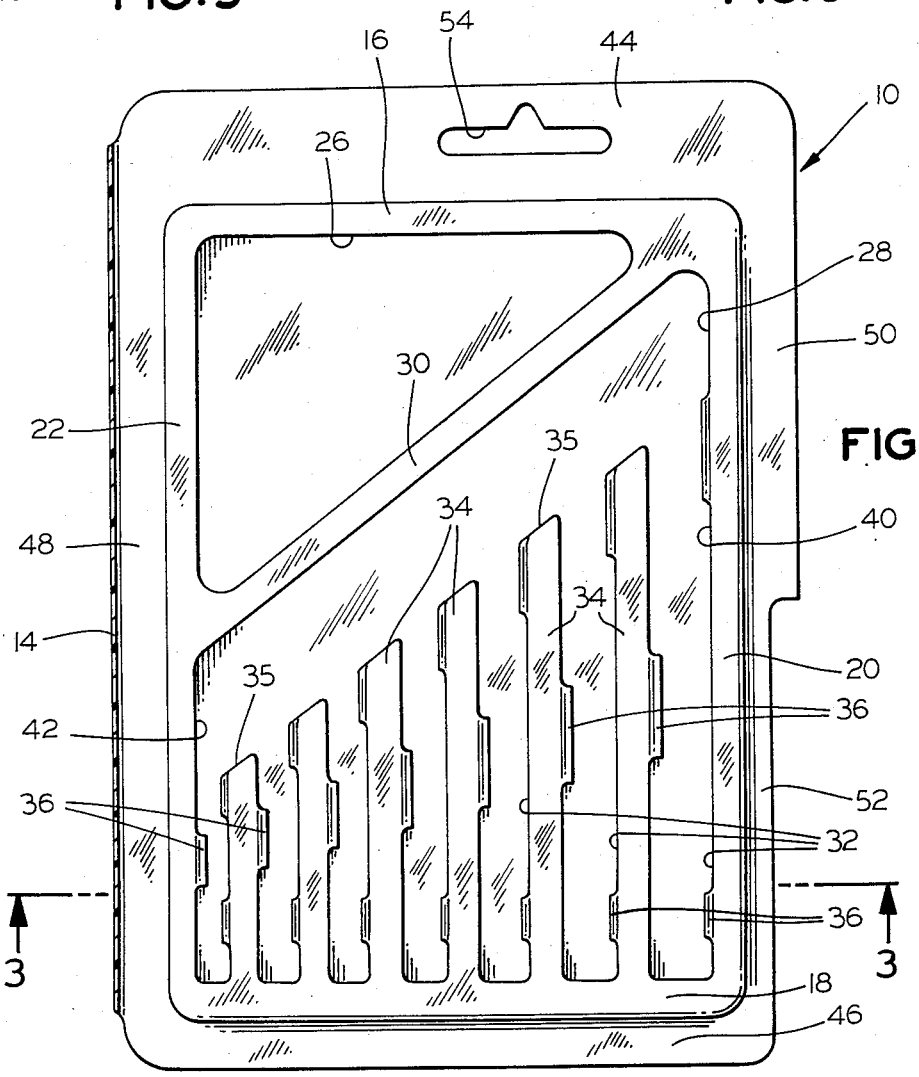
FIG. 2 is a plan view of the base component of the case of FIG. 1 drawn to an enlarged scale.

The card insert may be varied by changing the configuration of the opening or openings provided. This is illustrated in FIG. 6 wherein, instead of having a single rhomboidal opening such as 64, the card generally designated by the numeral 68 has four parallel slots 70 formed therein. These slots are aligned over certain of the recesses 32, thereby adapting the same case for packaging and displaying only four (rather than the full complement of seven) drill bits 66.

The procedures and conditions used to thermoform the case of the invention are conventional and will be evident to those skilled in the art. Suitable plastics for use include polyvinyl chloride and vinyl chloride interpolymers polyolefins such as polyethylene and polypropylene, and the monovinylidene aromatic hydrocarbons such as polystyrene and rubber modified polystyrene materials (HIPS); other suitable materials will also be apparent. Generally, the case will be formed from sheet material that is about 10 to 20 mils in thickness, but this will of course depend upon many factors, including the conditions of operation, the particular plastic used, the properties desired in the final package, etc.

It should be appreciated that, because the case will generally be of fairly light-gauge construction, it will be strippable from mold parts with relative facility, despite the presence of undercut portions, such as would be involved in forming the reversely tapered sidewall elements, as described. Other interfitting elements may also be readily formed into the parts of the case such as to provide, for example, a locking tongue and groove feature affording snap-fit interengagement between the base and the closure, if so desired. Ever tacky adhesive stripes on the mating surfaces of the flanges may also be used. More permanent fastening means, such as the wire staples illustrated, will ordinarily be used to secure the contents against pilferage at the point of sale.

Thus, it can be seen that the present invention provides a novel integrally thermoformed plastic case for a set of twist drill bits and the like, which case is relatively facile and inexpensive to produce. The case is well-suited for packaging elongated tool parts in a secure and attractive manner, and is of adequate durability to enable reuse for storage of the parts by the consumer. The invention also provides a novel package comprised of such a plastic case, and a set of elongated tool parts contained therewithin. The package may have means therein for advertising and identifying the parts, while also contributing to the attractive and effective display thereof.

Having thus described the invention, what is claimed is:

1. A one-piece case for holding a multiplicity of elongated tool parts comprising: a base component, a closure component, and a connecting hinge component along one side of said base and closure components, said base, closure and hinge components being integrally thermoformed from sheeting of synthetic resinous material; said base component including a peripheral flange portion and an upstanding pedestal portion therewithin, said pedestal portion having a multiplicity of upstanding peripheral ribs of generally inverted U-shaped configuration defining an upwardly opening cavity therewithin and a peripheral sidewall element extending thereabout, said pedestal portion also having a multiplicity of upstanding internal rib formations dividing said cavity into a multiplicity of elongated tool-receiving recesses, at least a majority of said internal ribs being in parallel spaced relationship to define parallel extending tool-receiving recesses, said peripheral flange portion extending about the lower, outer edge of said sidewall element; said closure component being povitable about said integral hinge component between a closed position overlying said base component and an open position displaced therefrom, said closure component having a cover element for overlying said cavity of said base component, a peripheral sidewall element depending therefrom, and a peripheral flange portion about the lower edge of said sidewall element; said pedestal portion of said base component seating within the cavity of said closure component in said closed position of said case, with said cover element overlying said cavity of said base component, said flange portions thereof in face-to-face surface contact, and with said respective sidewall elements thereof in frictional interengagement.

2. The case of claim 1 wherein said sidewall elements of said base component and said closure component extend continuously thereabout, the abutting surfaces thereof being cooperatively inclined relative to their respective flange portions to increase the force of interengagement therebetween.

3. The case of claim 2 wherein said internal rib formations extend generally parallel to one another and are of progressively increasing length and spacing from one another.

4. The case of claim 3 wherein said internal rib portions are of generally inverted U-shaped configuration and have at least one boss along the length thereof projecting from at least one sidewall thereof into the recess, defined therebetween, and adapted to frictionally grip the surface of an article deposed in the recess.

5. The case of claim 3 wherein said pedestal portion is of generally rectangular configuration, wherein the inner ends of said internal rib formations lie on an imaginary diagonal line extending thereacross, and wherein said pedestal portion additionally includes a rib formation spaced from said inner ends of said internal rib formations and extending diagonally across said pedestal portion at an angle parallel to said imaginary line, said rib formations cooperatively defining a generally rhomboidal section within said cavity.

6. The case of claim 1 wherein said internal rib formations project inwardly of the cavity from the peripheral ribs and are of generally inverted U-shaped configuration.

7. The case of claim 1 wherein said peripheral flange portions extend entirely about said base and closure components, wherein said hinge component extends between the outer edges of said flange portions along one side of said case, and wherein the flange portion of one of said base and closure components on the opposite side of said case is of lesser dimension than is the corresponding flange portion of the other of said components, to permit ready access thereto and separation thereof, to open said case.

8. A package of elongated tool parts, comprising:

(a) a one-piece case integrally thermoformed from sheeting of a synthetic resinous material, and comprising a base component, a closure component, and a connecting hinge component along one side of said base and closure components, said base component including a peripheral flange portion and an upstanding pedestal portion having a multiplicity of upstanding peripheral ribs of generally inverted U-shaped configuration defining an upwardly opening cavity therewithin and a peripheral sidewall element extending thereabout, said pedestal portion having a multiplicity of upstanding internal rib formations dividing said cavity into a multiplicity of elongated tool-receiving recesses, at least the majority of said internal ribs being in parallel spaced relationship to define parallel extending tool-receiving recesses, said peripheral flange portion extending about the lower, outer edge of said sidewall element, said closure component being pivotable about said integral hinge component between a closed position overlying said base component and an open position displaced therefrom, said closure component having a cover element overlying said cavity of said base component, a peripheral sidewall element depending therefrom, and a peripheral flange portion about the lower edge of said sidewall element, said pedestal portion of said base component seating within the cavity of said closure component in said closed position of said case, with said cover element overlying said cavity of said base component, with said flange portions being in face-to-face surface contact and with said respective sidewall elements thereof being in frictional interengagement; and (b) a multiplicity of elongated tool parts, each of said parts being held within one of said tool-receiving recesses.

9. The package of claim 8 wherein said synthetic resinous material is substantially transparent, and wherein said case includes a card insert disposed within said cavity of said closure component and conforming substantially to the configuration thereof, said card insert having at least one opening formed therein through which tool parts held within said recesses are visible.

10. The package of claim 9 wherein said internal rib formations are generally parallel to one another and are of progressively increasing length and spacing from one another, said case being adapted to hold a set of twist drill bits within said recesses between said internl rib formations.

11 The package of claim 10 wherein said pedestal portion is of generally rectangular configuration, and wherein the inner ends of said internal rib formations lie on an imaginary diagonal line extending thereacross, said pedestal portion additionally including a rib formation spaced outwardly from said ends of said internal rib formations and extending diagonally across said pedestal portion at an angle parallel to said imaginary line, said rib formations cooperatively defining a generally rhomboidal section within said concavity adapted to receive the ends of drill bits held within said recesses.

12. The package of claim 11 wherein said opening of said card insert is shaped to conform to said cavity section of said pedestal portion and is aligned therewith so that the ends of the the drill bits are visible therethrough.

13. The package of claim 9 wherein said card has a series of slots formed therein, aligned over said recesses to render a tool part held therewithin visible therethrough.

14. The package of claim 8 wherein said package additionally includes means for securing said closure component to said base component in said closed position.

15. The package of claim 14 wherein said securing means comprises at least one fastener member engaging said overlying marginal flange portions.

* * * * *